US009938757B2

(12) United States Patent
Raffi et al.

(10) Patent No.: US 9,938,757 B2
(45) Date of Patent: Apr. 10, 2018

(54) PANEL LOCK

(71) Applicant: Dorel Juvenile Group, Inc., Foxboro, MA (US)

(72) Inventors: Laura Kay Raffi, Holliston, MA (US); Steve L. Torosian, York, ME (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 89 days.

(21) Appl. No.: 14/965,146

(22) Filed: Dec. 10, 2015

(65) Prior Publication Data

US 2016/0168892 A1 Jun. 16, 2016

Related U.S. Application Data

(60) Provisional application No. 62/090,967, filed on Dec. 12, 2014.

(51) Int. Cl.

| | |
|---|---|
| ***B65D 27/30*** | (2006.01) |
| ***B65D 33/34*** | (2006.01) |
| ***B65D 55/06*** | (2006.01) |
| ***G09F 3/03*** | (2006.01) |
| ***E05C 19/18*** | (2006.01) |
| ***E05B 53/00*** | (2006.01) |
| ***E05B 65/00*** | (2006.01) |
| ***E05B 15/16*** | (2006.01) |
| ***A47K 13/24*** | (2006.01) |
| *E05C 17/04* | (2006.01) |
| *E05C 1/08* | (2006.01) |
| *E05C 1/12* | (2006.01) |

(52) U.S. Cl.

CPC ..... *E05C 19/188* (2013.01); *A47K 13/242* (2013.01); *E05B 15/1607* (2013.01); *E05B 53/003* (2013.01); *E05B 65/0014* (2013.01)

(58) Field of Classification Search

CPC ..... Y10T 24/45524; Y10T 24/45529; B65D 55/089; B65D 2215/00; B65D 2215/02; B65D 2215/04; B65D 2215/06; B65D 2215/08; B65D 50/00; B65D 41/32; B65D 51/20; B65D 50/02; B65D 50/04; B65D 50/06; B65D 50/068; B65D 50/069; A44B 11/266; E05C 19/188; A47K 13/242; E05B 15/1607; E05B 53/003; E05B 65/0014

USPC ..... 292/262, 288, 289, 163, 164, 156, 174, 292/175; 4/253, 251; 49/394

See application file for complete search history.

(56) References Cited

U.S. PATENT DOCUMENTS 1,207,974 A * 12/1916 Miller ..... E05C 19/18 292/288
2,404,124 A * 7/1946 Des Roches ..... A47K 13/242 292/259 R
2,431,263 A * 11/1947 Lundgren ..... A47K 13/12 16/327
2,446,951 A * 8/1948 Quilter ..... B64D 17/32 24/609

(Continued)

OTHER PUBLICATIONS

Dreambaby. "EZY-Check (R) Dreambaby (R) Multi-Use Latch" Sep. 2, 2014.*

(Continued)

*Primary Examiner* — Kristina R Fulton
*Assistant Examiner* — Faria F Ahmad
(74) *Attorney, Agent, or Firm* — Barnes & Thornburg LLP

(57) ABSTRACT

A panel lock is provided to lock a movable panel to a relatively stationary base.

21 Claims, 9 Drawing Sheets

(56) References Cited

U.S. PATENT DOCUMENTS 2,698,439 A * 1/1955 Bruckner ..... A47K 13/242 4/253
2,924,476 A * 2/1960 Deane ..... E05C 19/18 109/63.5
2,996,731 A * 8/1961 Leptrone ..... A47K 13/242 292/339
3,024,472 A * 3/1962 Hardenbrook ..... A47K 13/242 292/257
3,477,070 A * 11/1969 Kimber ..... A47K 13/242 4/253
3,893,725 A * 7/1975 Coulter ..... B65D 45/02 220/318
4,145,771 A * 3/1979 Khazin ..... A47K 13/242 24/16 PB
4,270,782 A * 6/1981 LaConte ..... E05C 19/18 292/288
4,404,715 A * 9/1983 Sugimoto ..... A44B 11/2523 24/633
4,413,851 A * 11/1983 Ritter ..... B65F 1/1615 292/259 R
4,479,273 A * 10/1984 Raden ..... A47K 13/242 4/236
4,502,167 A * 3/1985 Porzelius ..... A47K 13/242 4/253
4,524,470 A * 6/1985 Grenell ..... A47K 13/242 16/333
4,638,515 A * 1/1987 Caputo ..... A47K 13/245 292/254
4,658,447 A * 4/1987 Smith ..... A47K 13/12 16/329
D289,793 S * 5/1987 Blake ..... D23/309
4,715,629 A * 12/1987 Robinson ..... E05B 15/1607 292/256
4,736,472 A * 4/1988 Buckshaw ..... A47K 13/242 292/210
4,763,362 A * 8/1988 Eure ..... A47K 13/24 4/234
4,833,737 A * 5/1989 Boucher ..... A47K 13/242 292/266
4,894,870 A * 1/1990 Buckshaw ..... A47K 13/10 292/210
4,912,950 A * 4/1990 Crowle ..... A44B 11/266 24/167
4,976,371 A * 12/1990 Wise ..... B65D 45/02 220/315
5,003,641 A * 4/1991 Selman, Jr. ..... A47K 13/242 4/253
5,026,102 A * 6/1991 Pitman ..... E05C 19/005 292/259 R
5,052,061 A * 10/1991 Nichols ..... A47K 13/245 4/661
5,118,144 A * 6/1992 Garofalo, Jr. ..... B65D 45/22 220/324
5,203,597 A * 4/1993 Wheelock ..... E05B 65/0014 292/258
D336,330 S * 6/1993 Harshman ..... 4/253
5,240,212 A * 8/1993 Brodie ..... A47K 13/245 248/214
5,311,649 A * 5/1994 Suh ..... A44B 11/266 24/616
5,347,663 A * 9/1994 Yost ..... A47K 13/242 292/219
5,369,819 A * 12/1994 Capuano, Jr. ..... A47K 13/245 4/661
5,383,257 A * 1/1995 Krauss ..... A44B 11/266 24/616
5,388,876 A * 2/1995 Saincome ..... E05C 3/041 292/218
5,419,020 A * 5/1995 Murai ..... A44B 11/266 24/625
D366,542 S * 1/1996 Pierson ..... D30/152
5,481,764 A * 1/1996 Nelson ..... A61F 5/37 4/559
D372,965 S * 8/1996 Villeneuve ..... D23/311
5,548,879 A * 8/1996 Wu ..... A44B 11/263 24/616
5,551,131 A * 9/1996 Anscher ..... A44B 11/263 24/606
5,588,687 A * 12/1996 Pinkerton ..... E05B 15/1607 292/259 R
5,669,081 A * 9/1997 Scherer ..... A47K 13/242 16/DIG. 32
5,682,776 A * 11/1997 Burt ..... A47K 13/242 292/189
5,774,956 A * 7/1998 French ..... A44B 11/263 24/616
5,791,026 A * 8/1998 Anscher ..... A44B 11/266 24/615
D399,936 S * 10/1998 Scherer ..... D23/303
5,933,925 A * 8/1999 Anscher ..... A42B 3/08 24/163 R
6,138,330 A * 10/2000 Galbreath ..... A44B 11/263 24/625
6,145,172 A * 11/2000 Bourdon ..... A44B 11/266 24/616
6,163,942 A * 12/2000 Liao ..... A44B 11/266 24/591.1
6,226,805 B1 * 5/2001 Watkins ..... A47K 13/24 4/253
6,243,884 B1 * 6/2001 Simonson ..... A47K 13/12 220/831
6,299,040 B1 * 10/2001 Matias ..... A45F 5/00 224/254
6,311,374 B1 * 11/2001 Anscher ..... A44B 11/263 24/625
6,314,589 B1 * 11/2001 Schilt ..... A47K 13/242 4/253
6,435,572 B1 * 8/2002 Ticu ..... E05C 1/14 292/116
D478,023 S * 8/2003 Chen ..... D11/216
6,796,007 B1 * 9/2004 Anscher ..... A44B 11/2549 24/312
6,871,517 B2 * 3/2005 Bonelli ..... A44B 11/266 24/166
6,880,717 B1 * 4/2005 O'Conor ..... B65F 1/1615 220/315
6,935,661 B1 * 8/2005 Farnsworth ..... E05B 65/0057 292/120
6,948,278 B1 * 9/2005 Schultz ..... E05B 65/0876 292/163
7,073,235 B2 * 7/2006 Benedict ..... A44B 11/2519 24/633
7,089,633 B2 * 8/2006 Liu ..... A44B 11/266 24/615
7,150,082 B2 * 12/2006 Beletsky ..... A44B 11/263 24/625
7,181,936 B2 * 2/2007 Christensen ..... A44B 11/266 70/389
7,219,406 B2 * 5/2007 Chui ..... A44B 11/266 24/593.1
D550,821 S * 9/2007 Fraga ..... D23/309
7,264,285 B1 * 9/2007 Ross ..... E05B 13/002 24/67.3
7,380,843 B2 * 6/2008 Alacqua ..... E05B 47/0009 292/137
7,568,367 B2 * 8/2009 Huang ..... A44B 11/266 70/284
7,625,019 B2 * 12/2009 Alacqua ..... E05B 47/0009 292/137
7,725,993 B1 * 6/2010 Giampavolo ..... A44B 11/266 24/614
7,874,598 B2 * 1/2011 Chung ..... E05B 63/20 292/163
D638,332 S * 5/2011 Fair ..... D11/216
8,122,523 B2 * 2/2012 Li ..... A47K 13/12 4/236

(56) References Cited

U.S. PATENT DOCUMENTS 8,152,208 B2 * 4/2012 Varney ..... E05B 17/2038 292/198
8,176,605 B2 * 5/2012 Mok ..... A44B 11/266 24/613
8,403,374 B2 * 3/2013 Shimizu ..... E05B 83/30 292/137
8,459,487 B2 * 6/2013 Sharma ..... B65F 1/1615 220/315
8,484,814 B2 * 7/2013 Parisi ..... A44B 11/263 24/614
8,505,986 B2 * 8/2013 Sun ..... H01M 2/1022 292/137
8,544,803 B2 * 10/2013 Ball ..... F25D 23/00 248/154
D700,540 S * 3/2014 Kaneko ..... D11/216
8,720,018 B2 * 5/2014 Yoshie ..... A44B 11/266 24/615
8,727,393 B2 * 5/2014 Ruspil ..... E05B 63/20 292/137
8,740,262 B2 * 6/2014 Buchheit ..... E05B 63/242 292/163
8,827,326 B1 * 9/2014 Babij ..... E05B 63/0065 292/169.13
8,851,529 B2 * 10/2014 Chiang ..... H05K 5/0221 292/117
8,857,019 B1 * 10/2014 Nykoluk ..... A44B 11/2596 24/587.12
8,863,362 B2 * 10/2014 Kelleghan ..... A44B 11/266 24/615
8,914,919 B1 * 12/2014 Schubert ..... A47K 13/242 4/253
8,985,372 B2 * 3/2015 Yang ..... A47J 36/10 220/315
9,009,875 B2 * 4/2015 Smashey ..... A47K 13/242 4/253
9,032,767 B2 * 5/2015 Takahashi ..... A44B 11/2546 24/614
9,469,475 B2 * 10/2016 McDade ..... B65F 1/1615
9,521,882 B2 * 12/2016 Hung ..... A44B 11/2511
9,578,929 B2 * 2/2017 Hung ..... A44B 11/2511
D782,363 S * 3/2017 Postolek ..... D11/216
2002/0185871 A1 * 12/2002 Straka, Jr. ..... E05C 1/10 292/163
2004/0016763 A1 * 1/2004 Hilliard ..... B65D 83/0454 221/79
2004/0112098 A1 * 6/2004 Bonelli ..... A44B 11/266 70/58
2004/0226150 A1 * 11/2004 Beletsky ..... A44B 11/263 24/625
2006/0006665 A1 * 1/2006 Berg ..... E05C 19/06 292/175
2006/0053600 A1 * 3/2006 Liu ..... A44B 11/266 24/615
2006/0207302 A1 * 9/2006 Yu ..... E05B 37/0034 70/58
2006/0243006 A1 * 11/2006 Christensen ..... A44B 11/266 70/58
2007/0061954 A1 * 3/2007 Watkins ..... A47K 13/242 4/253
2007/0085352 A1 * 4/2007 Ulanday ..... E05C 17/365 292/288
2007/0120376 A1 * 5/2007 Bella ..... E05B 83/30 292/163
2008/0100068 A1 * 5/2008 Kim ..... B60N 3/083 292/163
2009/0100652 A1 * 4/2009 Mok ..... A44B 11/266 24/625
2009/0241306 A1 * 10/2009 Pontaoe ..... A44B 11/2534 24/614
2009/0255101 A1 * 10/2009 Lin ..... A01K 27/005 24/614
2010/0000056 A1 * 1/2010 Hsieh ..... A44B 11/16 24/163 R
2011/0018660 A1 * 1/2011 Fullerton ..... H01F 7/0242 335/295
2011/0219590 A1 * 9/2011 Anscher ..... A44B 11/266 24/606
2011/0219591 A1 * 9/2011 Parisi ..... A44B 11/263 24/633
2011/0271434 A1 * 11/2011 Smashey ..... A47K 13/242 4/253
2012/0260474 A1 * 10/2012 Yoshie ..... A44B 11/266 24/642
2013/0056998 A1 * 3/2013 Chincarini, Jr. ..... E05C 17/36 292/262
2013/0189631 A1 * 7/2013 Mojica ..... F23Q 1/06 431/274
2013/0205551 A1 * 8/2013 Wang ..... A44B 11/005 24/639
2014/0050468 A1 * 2/2014 Henry ..... G03B 17/561 396/423
2014/0283346 A1 * 9/2014 Mitchell, Jr. ..... A44B 11/16 24/68 E
2014/0367426 A1 * 12/2014 Yen ..... A44B 11/005 224/163
2016/0278487 A1 * 9/2016 Postolek ..... A44B 11/2573
2016/0340948 A1 * 11/2016 McCullough ..... E05C 19/188

OTHER PUBLICATIONS

Mommy's Helper, Inc. "Lid-LOK (TM)" Feb. 17, 2001.*
Mommy's Helper, Inc. "Appliance LOK (TM)" Nov. 8, 2007.*
Munchkin, Inc. Xtraguard Safety Accessories. "Xtraguard (TM) Dual Locking Multi Use Latch" Aug. 3, 2014.*
"Safety 1st Custom Fit All Purpose Strap" (2013).

* cited by examiner

40
LIFT TAB
103
100
10
32B
SECOND SQUEEZE BUTTON
LATCH
32
TETHER HOLDER
14
9A
8A
8A
102
22
9A
20
LATCH
FIRST SQUEEZE BUTTON
101
12
16
31
31B

A1
FIRST TETHER RELEASE ACTION
16
22
8B
MOVABLE PANEL
103
8B
10
16
20
PANEL TETHER
BASE
101
BASE MOUNT
12

A2
SECOND TETHER RELEASE ACTION
103
16
9B
22
10
20
9B
101
12

103
100
140
142
TETHER HOLDER
14
140T1
102
20
16
101
12
32
22
31
40

40
LIFT TAB
32B
LATCH
SECOND SQUEEZE BUTTON
32
16
22
20
12
TETHER HOLDER
14
LATCH
FIRST SQUEEZE BUTTON
10
31
31B

A1
FIRST TETHER RELEASE ACTION
16
PANEL TETHER
12
BASE MOUNT
203
MOVABLE PANEL
10
22
20
16
BASE
201

SECOND TETHER RELEASE ACTION
A2
12
10
22
20
16

TETHER HOLDER
14
12
22
16
20

40
LIFT TAB
32B
LATCH
SECOND SQUEEZE BUTTON
32
16
22
20
12
TETHER HOLDER
14
FIRST SQUEEZE BUTTON
10
LATCH
31
31B

A1
FIRST TETHER RELEASE ACTION
16
PANEL TETHER
12
BASE MOUNT
303
MOVABLE PANEL
10
22
20
16
BASE
301

SECOND TETHER RELEASE ACTION
A2
12
10
22
20
16

TETHER HOLDER
14
12
22
16
20

PANEL TETHER
FIRST LATCH
SECOND LATCH
LIFT TAB
BASE MOUNT
TETHER HOLDER

PANEL LOCK

PRIORITY CLAIM

This application claims priority to U.S. Provisional Application No. 62/090,967 filed Dec. 12, 2014, which is expressly incorporated by reference herein.

BACKGROUND

The present disclosure relates to a lock, and in particular, to a lock for a panel mounted for movement on a base. More particularly, the present disclosure relates to a panel lock that is coupled to a stationary base and a movable panel to block opening of the movable panel by an unauthorized person.

SUMMARY

A panel lock is configured to be mounted on a base by a caregiver to block a child from moving a movable panel relative to the base to gain access to an interior region provided in the base. In one illustrative embodiment, the base is a toilet bowl and the panel is a toilet lid mounted for movement relative to the toilet bowl between opened and closed positions. In other illustrative embodiments, the base is a cabinet and the panel is included in a drawer or door mounted for siding or swinging movement relative to the cabinet between opened and closed positions.

In illustrative embodiments, the panel lock includes a base mount, a tether holder, and a panel tether. The base mount is adapted to be mounted on a base such as a toilet bowl, cabinet, or other relatively stationary structure. The tether holder is adapted to be mounted on a panel such as a toilet lid, drawer, door, or other relatively movable structure. The panel tether has a lower end coupled to the base mount and an upper end that is configured to mate temporarily with the tether holder when the movable panel occupies a closed position to lock the movable panel in that closed position on the base.

In illustrative embodiments, the panel tether of the panel lock includes a strap coupled to the base mount and a strap anchor coupled to a free end of the strap. The strap anchor is configured to be mated temporarily by a caregiver with the tether holder that is mounted on the movable panel to lock the panel (e.g., lid, drawer, or door) in the closed position relative to the base (e.g., toilet bowl, cabinet, or other relatively stationary structure).

In illustrative embodiments, the tether holder of the panel lock includes a retainer-support plate mounted on an exterior surface of the movable panel (e.g., lid, drawer, or door) and formed to include a tab receiver sized to receive a lift tab. The tether holder also includes an upstanding anchor retainer that extends upwardly away from the retainer-support plate and the movable panel and is configured to mate with a latch.

In illustrative embodiments, the strap anchor of the panel tether includes (1) first and second spring-loaded latches and (2) a spring-loaded lift tab. The two spring-loaded latches are mounted for sliding movement in a latch housing included in the panel tether and can be mated easily by a caregiver with the upstanding anchor retainer included in the tether holder. The spring-loaded lift tab is mounted for pivotable movement on the latch housing and can be mated easily by the caregiver with the tab receiver formed in the retainer-support plate. The caregiver can lock movable panel (e.g., lid, drawer, or door) easily in the closed position simply by pushing the strap anchor downwardly onto the underlying anchor retainer until the two sliding spring-loaded latch members snap into engagement with the anchor retainer and the pivotable lift tab snaps into the tab receiver and under a flange formed in the retainer-support plate that is mounted on the exterior surface of the movable panel.

In illustrative embodiments, the strap anchor is configured to require the caregiver to apply two separate tether-release actions to the strap anchor at the same time to unlock the panel lock. First, a squeezing force is applied to exposed first and second squeeze buttons provided on the outer ends of the first and second latches to move those latches relative to the latch housing and toward one another from latched positions to unlatched positions to unmate from the upstanding anchor retainer of the tether holder. Second, while the caregiver continues to apply the squeezing force to the squeeze buttons to cause the latches to be held in unlatched positions, a lifting force is applied by the caregiver to the lift tab to cause the lift tab to pivot relative to the latch housing of the strap anchor about a tab-pivot axis and move from an extended position to a withdrawn position so as to unmate from the retainer-support plate of the tether holder. It is within the scope of the present disclosure to apply the lifting force to the lift tab and while doing so apply the squeezing force to the squeeze buttons.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which:

FIG. 2A is a perspective view of a panel (toilet-lid) lock in accordance with the present disclosure coupled to a toilet to lock the toilet lid in a closed position relative to an underlying toilet seat and toilet bowl and suggesting that the panel (toilet-lid) lock includes a base mount coupled to the toilet bowl, a tether holder coupled to the lid as shown in FIG. 2D, and a panel (lid) tether including a strap having a lower end coupled to the base mount and a strap anchor coupled to an upper end of the strap and mated with the underlying tether holder, and suggesting that the strap anchor includes two squeeze buttons and a lifting tab that can be operated together as suggested in FIGS. 2C and 2D by a caregiver to separate the panel (lid) tether from the tether holder to unlock the panel (toilet-lid) lock as suggested in FIG. 2D;

FIG. 2B is a view similar to FIG. 2A suggesting that a first tether-release action is carried out by applying squeezing forces to the two squeeze buttons included in the strap anchor of the panel (lid) tether;

FIG. 2C is a view similar to FIGS. 2A and 2B suggesting that a second tether-release action is carried out by applying a lifting force to the lifting tab included in the strap anchor of the panel (lid) tether;

FIG. 2D is a view similar to FIGS. 2A-2C showing that the panel (lid) tether has been separated from a tether holder mounted on the toilet lid to unlock the toilet lid lock;

DETAILED DESCRIPTION

Figure 1A:
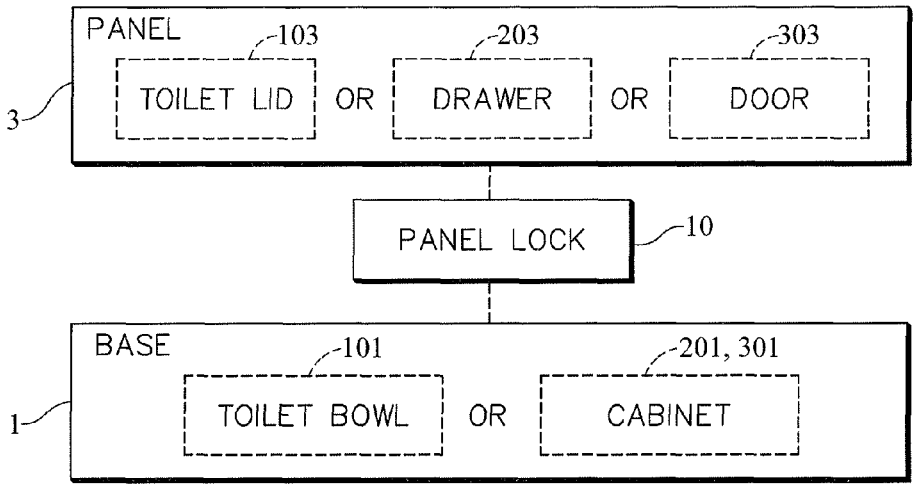
FIG. 1A is a block diagram showing that a panel lock in accordance with the present disclosure can be used to lock a panel to a base and suggesting that it can be used to lock a toilet lid to a toilet bowl or a drawer or door to a cabinet.
Figure 1B:
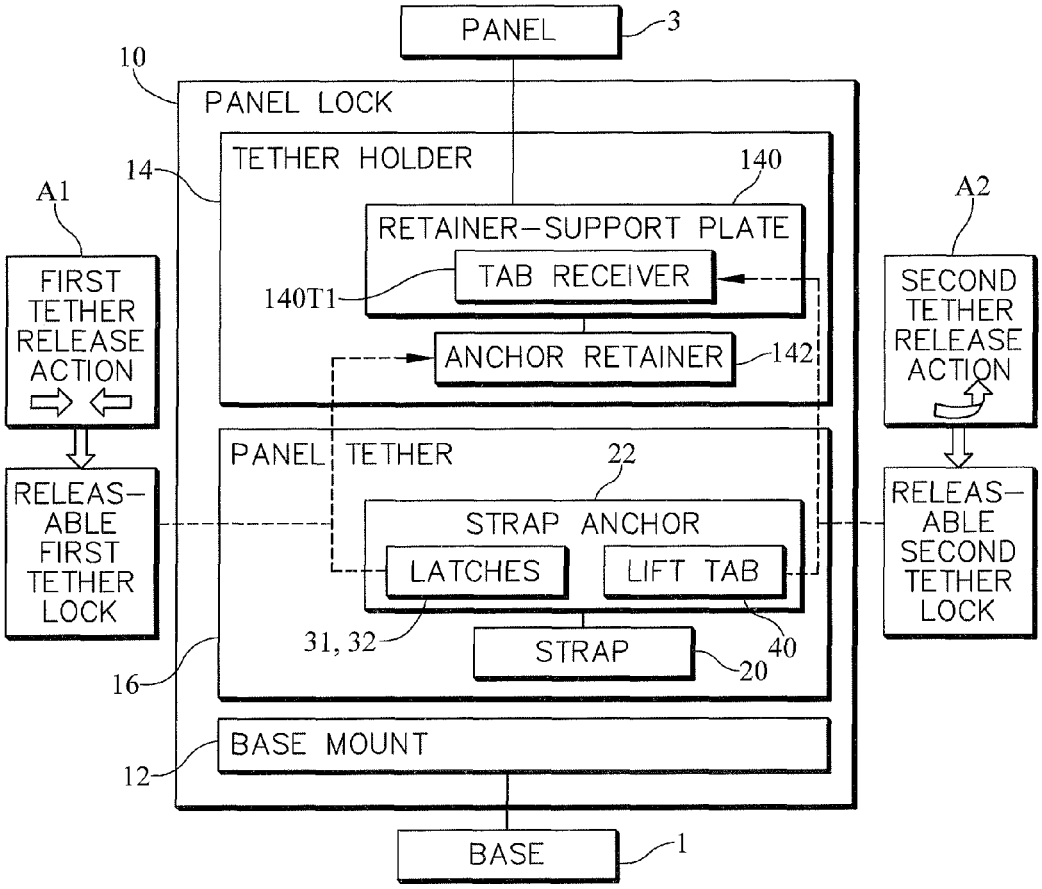
FIG. 1B is a block diagram showing that a panel lock in accordance with the present disclosure comprises a base mount that is adapted to be mounted on a relatively stationary base, a tether holder adapted to be mounted on a movable panel, and a panel tether that is coupled to the base mount and configured to engage the tether holder temporarily to lock the movable panel to the relatively stationary base and suggesting that (1) a latch in the panel tether can engage an anchor retainer in the tether holder to establish a releasable first tether lock and (2) a lift tab in the panel tether can engage a tab receiver in the tether holder to establish a releasable second tether lock and further suggesting that two tether release actions are required of a caregiver to disengage the latch from the anchor retainer and the lift tab from the tab receiver and thereby unlock the panel lock.

A panel lock 10 in accordance with the present disclosure is used to lock a movable panel 3 to a relatively stationary base 1 as suggested diagrammatically in FIGS. 1A and 1B. In one illustrative embodiment, panel lock 10 can be used to lock a movable toilet lid 103 to a relatively stationary toilet bowl 101 as suggested diagrammatically in FIG. 1A and illustratively in FIGS. 2A-2D. In other illustrative embodiments, panel lock 10 can be used to lock a slidable drawer 203 to a relatively stationary cabinet 201 as suggested diagrammatically in FIG. 1A and illustratively in FIGS. 3A-3D or to lock a swinging door 303 to a relatively stationary cabinet 301 as suggested diagrammatically in FIG. 1A and illustratively in FIGS. 4A-4D.

Panel lock 10 includes a base mount 12, a tether holder 14, and a panel tether 16 as suggested diagrammatically in FIG. 1B. Base mount 12 is adapted to be mounted on a base 1 such as a toilet bowl 101, cabinet 102, or other relatively stationary structure. Tether holder 14 is adapted to be mounted on a movable panel 3 such as a toilet lid 103, slidable drawer 203, or swinging door 303. Panel tether 16 is permanently coupled to base mount 12 and configured to be engaged to and disengaged from tether holder 14 at the option of a caregiver or other panel-lock user.

Panel tether 16 includes a strap 20 and a strap anchor 22 as suggested diagrammatically in FIG. 1B. Strap anchor 22 is configured to be engaged temporarily to tether holder 14 by a user to lock panel lock 10. Strap anchor 22 is also configured to be disengaged from tether holder 14 by a user that applies two tether release actions A1, A2 to strap anchor 22 to unlock panel lock 10 as suggested diagrammatically in FIGS. 1B, 2B, and 2C. Strap 20 has one end coupled to base mount 12 and another end coupled to base mount 12 and another end coupled to strap anchor 22.

Strap anchor 22 of panel tether 16 includes one or two movable latches 31, 32 and a movable lift tab 40 as suggested in FIG. 1B. In illustrative embodiments, latches 31, 32 are mounted for sliding movement away from one another to engage tether holder 14 and toward one another to disengage tether holder 14 as suggested in FIGS. 5B and 5C. In illustrative embodiments, lift tab 40 is mounted for pivotable movement toward tether holder 14 to engage a tab receiver 140T1 formed in tether holder 14 and away from tether holder 14 to disengage tab receiver 140T1 formed in tether holder 14 as suggested in FIGS. 9A and 9B.

Tether holder 14 includes a retainer-support plate 140 as suggested diagrammatically in FIG. 1B. Retainer-support plate 140 is adapted to be mounted on a movable panel 3 and formed to include a tab receiver 140T1 that is arranged to mate with lift tab 40 included in strap anchor 22 of panel tether 16. Anchor retainer 142 is arranged to mate with one or more latches 31, 32 included in strap anchor 22 of panel tether 16.

Figures 2A, 2B, 2C, 2D:
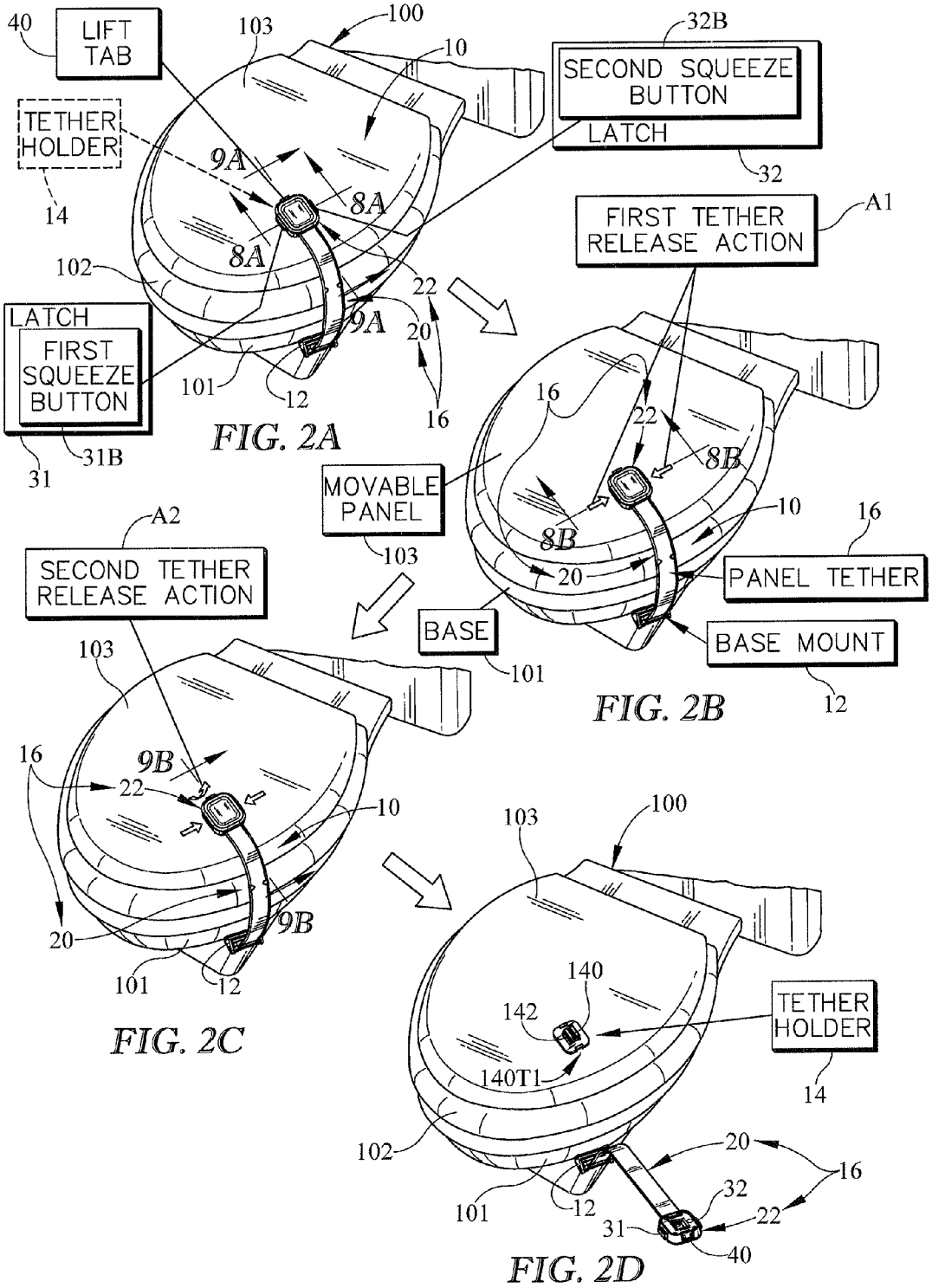
FIGS. 2A-2D show an unlocking sequence for a panel lock made in accordance with the present disclosure and used to lock a toilet lid to a toilet bowl.
Figure 6:
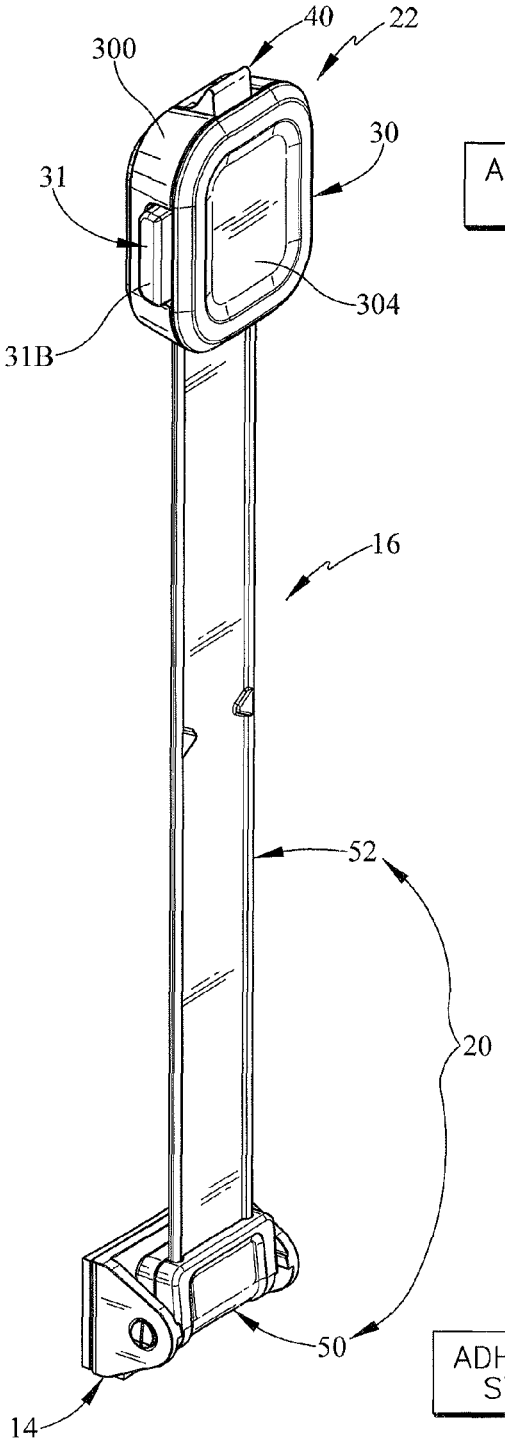
FIG. 6 is a top perspective view of the panel (toilet-lid) lock of FIG. 2A.
Figure 7:
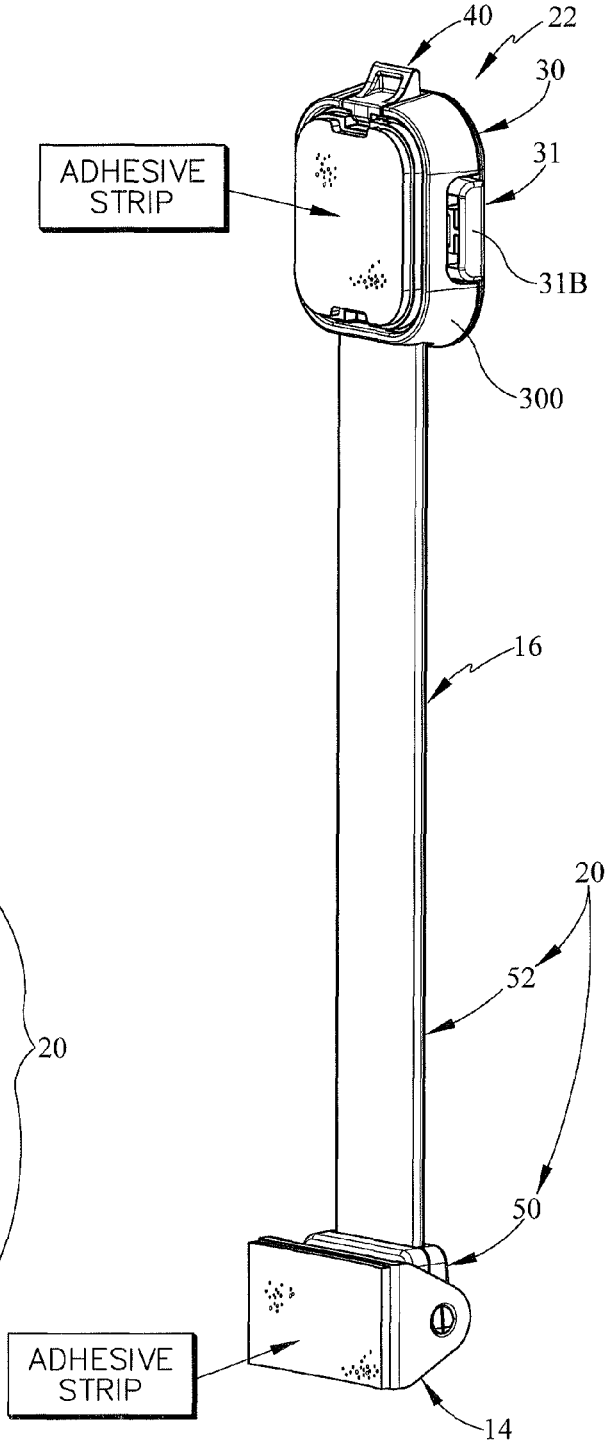
FIG. 7 is a bottom perspective view of the panel (toilet-lid) lock of FIGS. 2A and 6.

A panel lock 10 in accordance with the present disclosure includes a base mount 12 a tether holder 14, and a panel (lid) tether 16. Base mount 12 is mounted on a toilet base 101 of a toilet 100 in an illustrative embodiment shown in FIGS. 2A-2D. Tether holder 14 is mounted on a toilet-lid panel 103. Panel (lid) tether 16 includes a strap 20 coupled to tether holder 14 and a strap anchor 22 coupled to a free end of strap 20 as suggested in FIG. 2D. Strap anchor 22 of panel (lid) tether 16 is configured to engage tether holder 14 to lock toilet-lid panel 103 in a closed position trapping a toilet seat 102 between toilet-lid panel 103 and toilet base 101 as shown in FIG. 2A. To unlock panel lock 10, a caregiver must apply squeezing forces to first and second squeeze buttons 31B, 32B associated with first and second spring-loaded slidable latches 31, 32 included in strap anchor 22 as suggested in FIGS. 2 and 6B and then apply a lifting force to a spring-loaded pivotable lift tab 40 included in strap anchor 22 as suggested in FIGS. 3 and 7B so that strap anchor 22 of panel (lid) tether 16 can be unmated from tether holder 14 as shown in FIG. 2D.

Figures 5A, 5B, 5C:
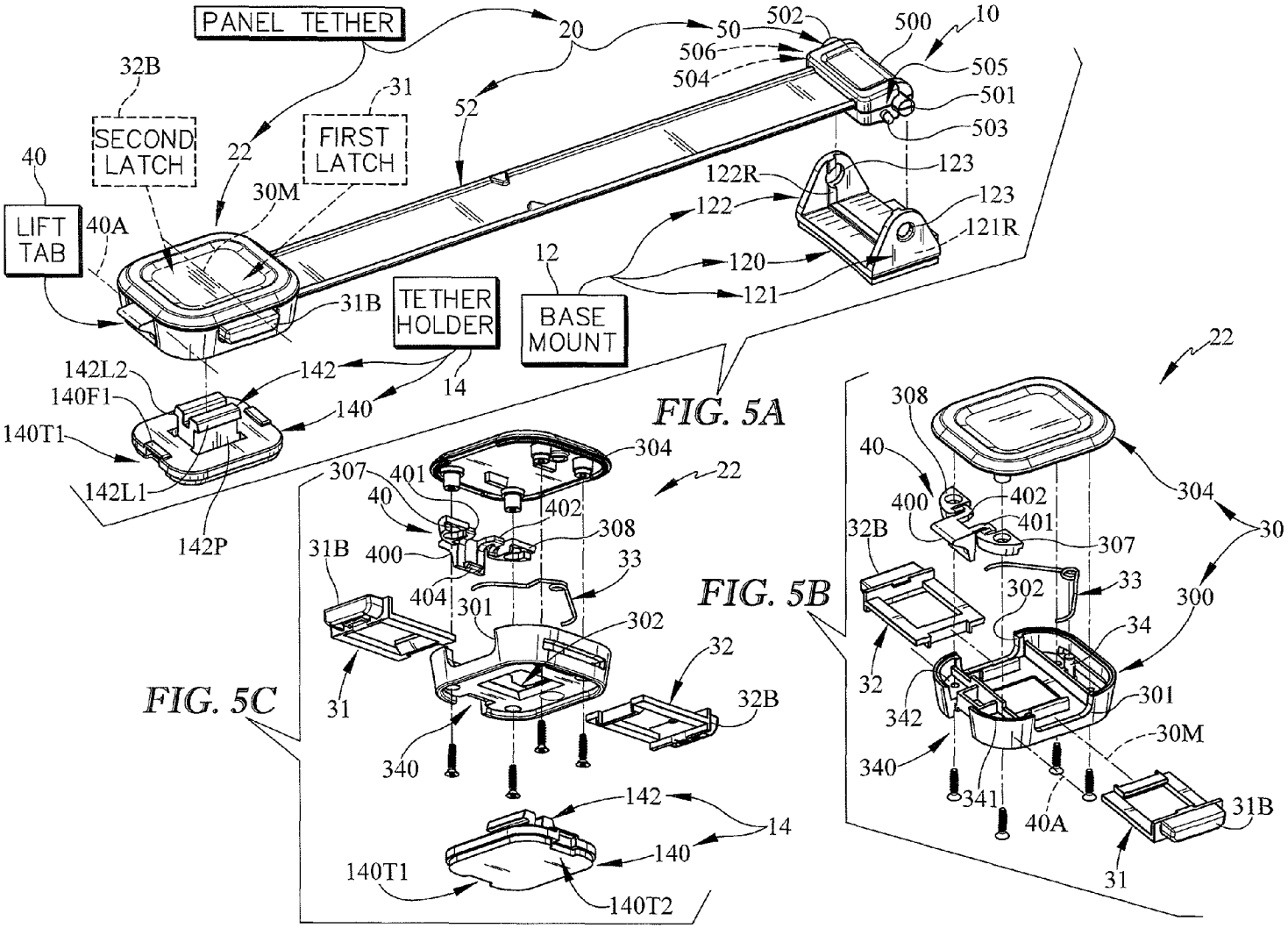
FIG. 5A is an exploded perspective assembly view of a panel lock in accordance with the present disclosure showing (1) an elongated panel (lid) tether comprising a strap anchor (on the left) and a strap including a strip support (on the right) and a flexible strip arranged to interconnect the strap anchor and the strip support, (2) a tether holder arranged to lie under the strap anchor and formed to include a retainer-support plate having a tab receiver associated with the lift tab of the strap anchor and an upstanding anchor retainer associated with the two latches and squeeze buttons of the strap anchor and (3) a base mount arranged to lie under the strip mount of the strap and suggesting that the strap anchor includes slidable first and second latches and a pivotable lift tab.
FIG. 5B is an exploded perspective assembly view of the strap anchor of the panel (lid) tether showing a first squeeze button on a near end of a first slidable latch, a second squeeze button on a far end of a second slidable latch, and a pivotable lift tab.
FIG. 5C is a view similar to FIG. 5B taken from another point of view showing that a lower portion of the lift tab includes a cantilevered motion-blocking tang (shown in more detail in FIGS. 9A and 9B)

Strap anchor 22 of panel (lid) tether 16 includes, as shown in FIG. 5B, a latch housing 30, first and second latches 31, 32 mounted for slidable movement in and relative to latch housing 30 along a latch-motion line 30M toward and away from one another, a latch-biasing spring 33 mounted on a post 34 included in latch housing 30 and arranged to engage each of latches 31, 32, and a lift tab 40 mounted for pivotable movement on latch housing 30 about a tab-pivot axis 40A that is arranged to lie in spaced-apart parallel relation to latch-motion line 30M as suggested in FIGS. 5A and 5B. Latch-biasing spring 33 provides means for yieldably moving first and second latches 31, 32 away from one another to cause a first squeeze button 31B provided on a near end of first latch 31 to project outwardly in a first direction through a first side aperture 301 formed in latch housing 30 and to cause a second squeeze button 32B provided on a far end of second latch 32 to project outwardly in an opposite second direction through a second side aperture 302 formed in latch housing 30.

Figure 9A:
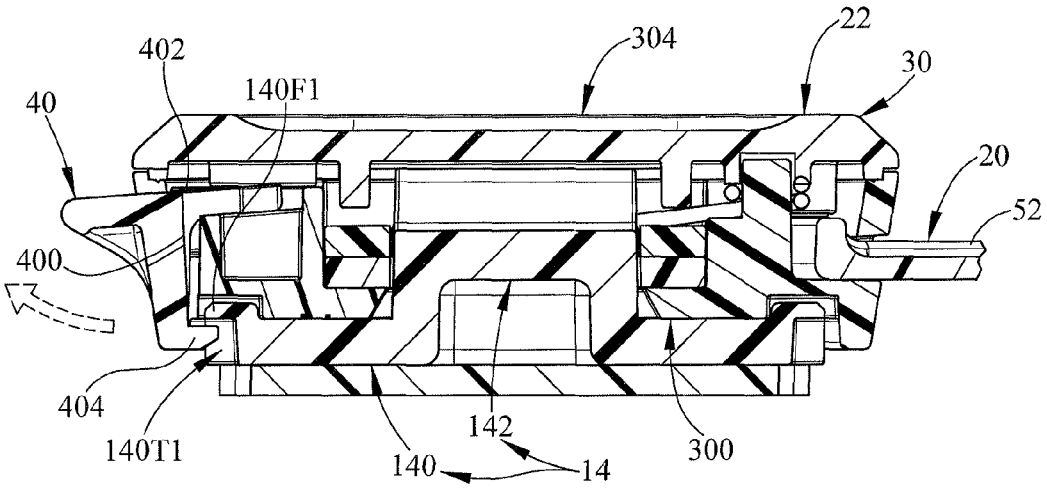
FIG. 9A is an enlarged sectional view of the strap anchor of the panel (lid) tether taken along line 9A-9A of FIG. 2A showing mating engagement of the pivotable lift tab and the retainer-support plate caused by insertion of a motion-blocking tang of the lift tab into a tab receiver formed in the retainer-support plate when the lift tab is arranged to lie in its normal extended position.
Figure 9B:
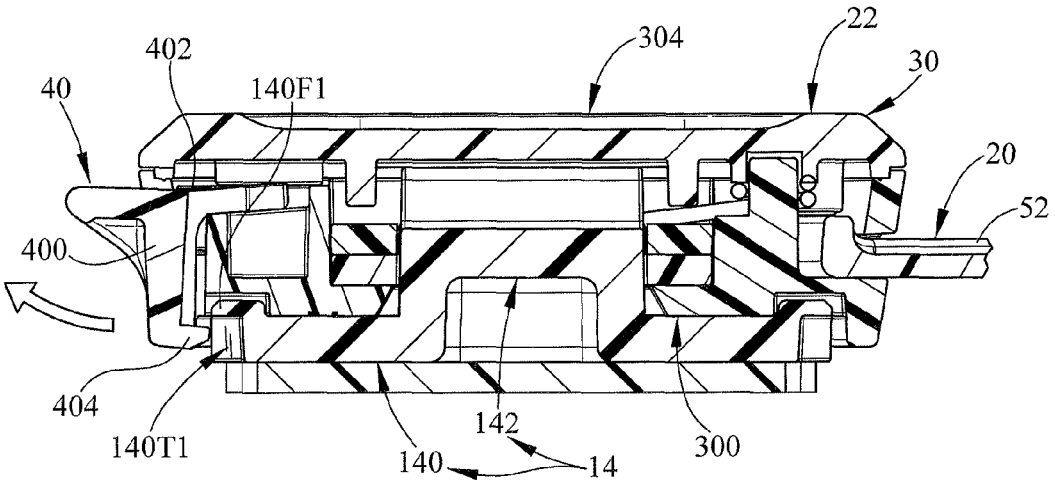
FIG. 9B is an enlarged sectional view of the strap anchor of the panel (lid) tether taken along line 9B-9B of FIG. 2C after a lifting force has been applied by a caregiver to the lift tab (while continuing to apply squeezing forces to the squeeze buttons of the slidable latches) to pivot the lift tab upwardly about a tab-pivot axis from the extended position to a withdrawn position to unmate the lift tab from the retainer-support plate of the tether holder, thereby freeing the strap anchor of the panel (lid) tether to be separated from the tether holder mounted on the toilet lid.

Lift tab 40 includes a finger grip 40D and a motion-blocking tang 404 cantilevered to an inwardly facing surface of finger grip 401 as shown, for example, in FIGS. 5C, 9A, and 9B. Lift tab 40 also includes a first elastic support arm 401 coupled to one side of finger grip 40D and a second elastic support arm 402 coupled to another side of finger grip 400 as shown, for example, in FIGS. 5A and 5B. Lift tab 40 is mounted on latch housing 30 for pivotable movement about a tab-pivot axis 40A between an extended position shown in FIG. 9A and a withdrawn position shown in FIG. 9B during a second tether-release action suggested in FIG. 3.

Latch housing 30 includes a hollow base 300 and a base closure 304 adapted to be mounted on top of hollow base 300 as suggested in FIGS. 5A and 5B to cover the slidable first and second latches 31, 32 that extend into an interior region 305 bounded by hollow base 300 and base closure 304. Base 300 is formed to include first and second apertures 301, 302 that open into interior region 305 as suggested in FIG. 5B. Spring-support post 34 is coupled to a floor of hollow base 300 and arranged to support latch-biasing spring 33 in interior region 305 of latch housing 30. Hollow base 300 also includes a lift-tab channel 340 flanked by first and second pad-support platforms 341, 342 and sized to receive motion-blocking tang 404 of lift tab 40 therein as suggested in FIGS. 5B and 9A.

Latch housing 30 also includes a first tab-mount pad 307 coupled to a free end of first elastic support arm 401 of lift tab 40 and a second tab-mount pad 308 coupled to a free end of second elastic support arm 402 of lift tab 40 as shown, for example, in FIGS. 5B and 5C. First tab-mount pad 307 is configured to mate with first pad-support platform 341 of base 300 as suggested in FIG. 5B. Second tab-mount pad 308 is configured to mate with second pad-support platform 342 of base 300 as suggested in FIG. 5B.

Figures 3A, 3B, 3C, 3D:
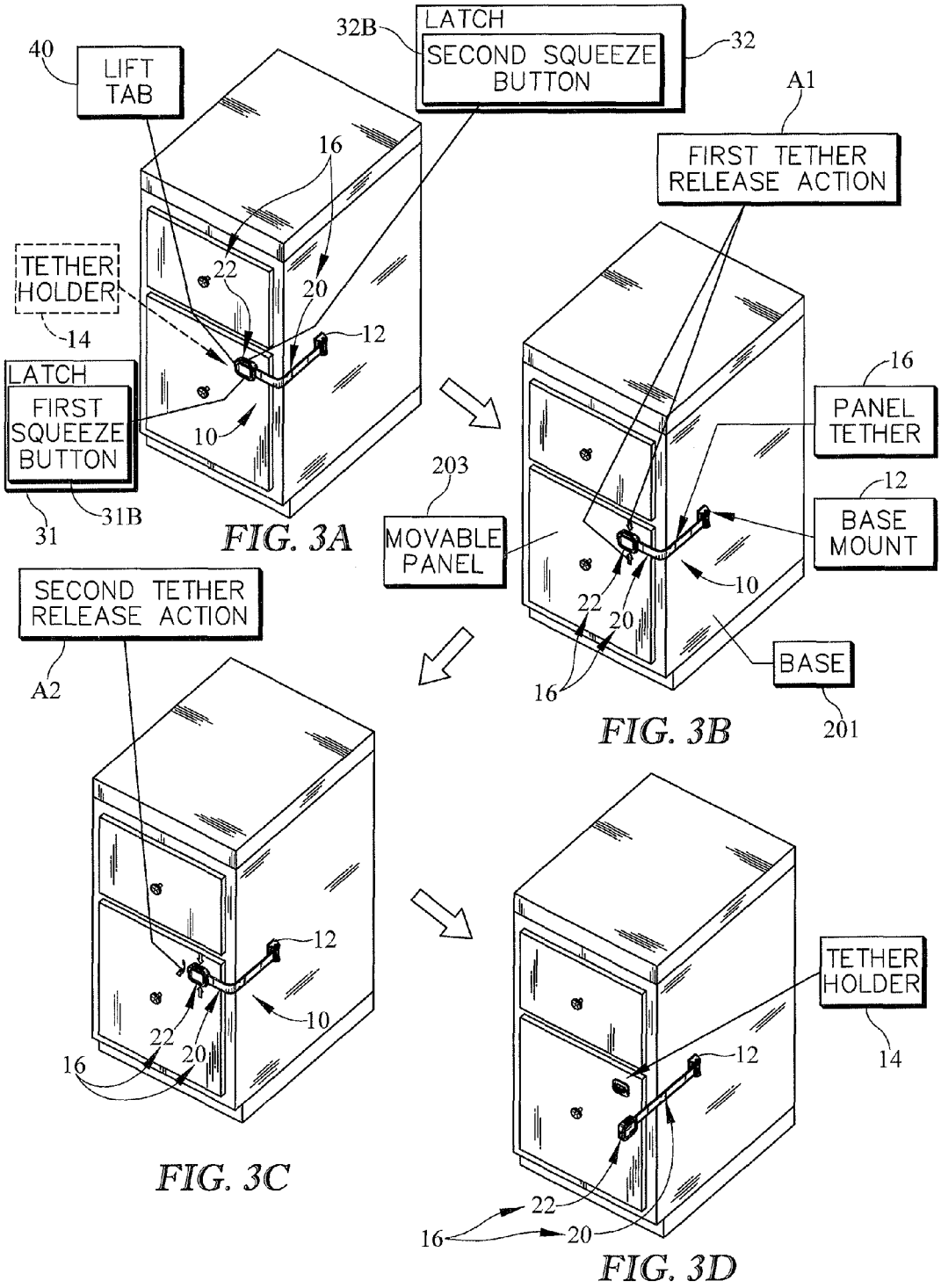
FIGS. 3A-3D show an unlocking sequence for a panel lock made in accordance with the present disclosure and used to lock a panel in a sliding drawer to a cabinet configured to receive the sliding drawer.
Figures 4A, 4B, 4C, 4D:
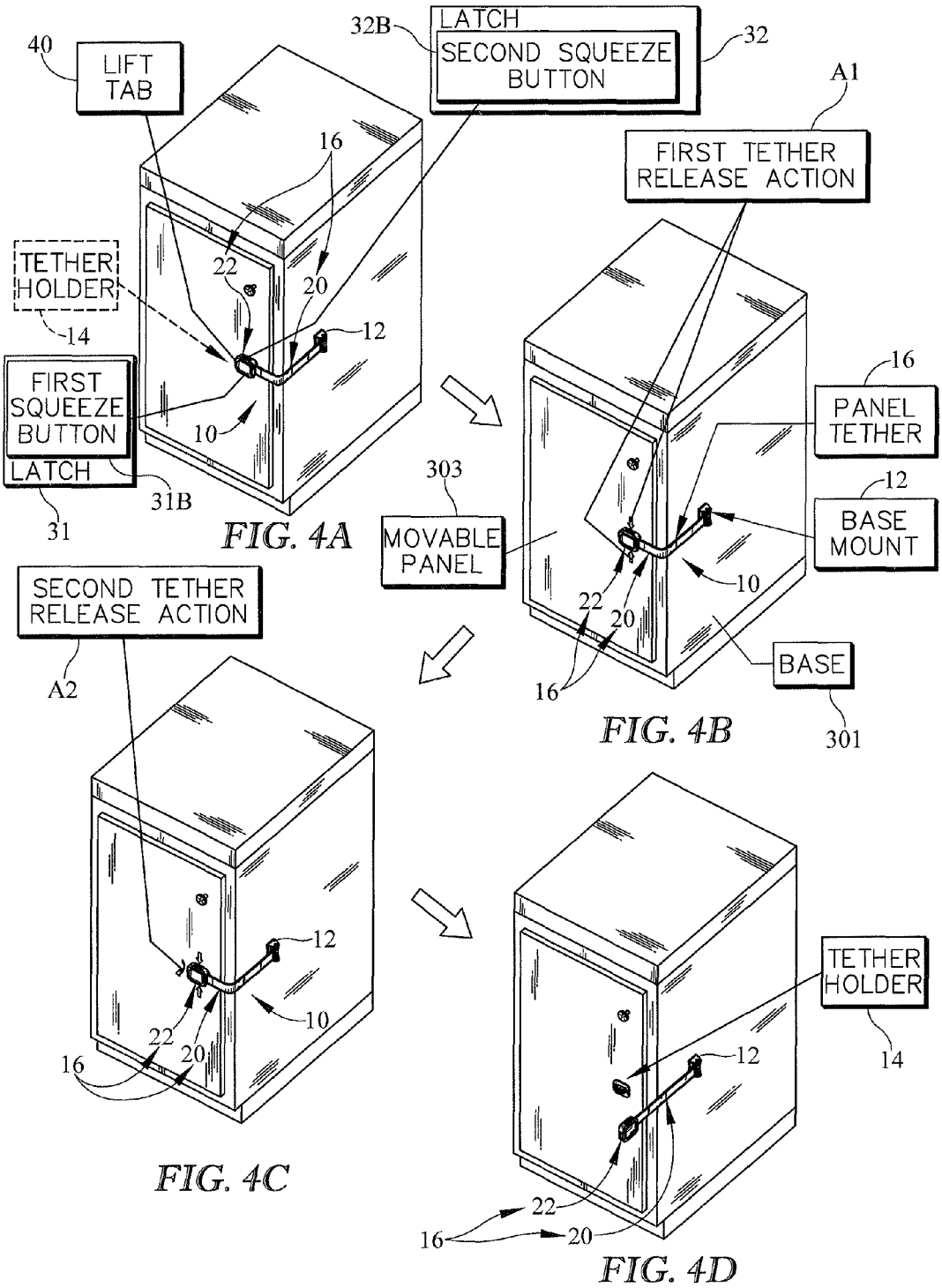
FIGS. 4A-4D show an unlocking sequence for a panel lock made in accordance with the present disclosure and used to lock a panel in a swinging door to a cabinet configured to support the swinging door.

Strap 20 of lid tether 16 includes a strip support 50 adapted to mate with base mount 12 and a flexible strip 52 arranged to interconnect strip support 50 and strap anchor 22 as shown, for example, in FIGS. 3A, 3D, and 5. Flexible strip 52 may be made of any suitable pliable material. Strip support 50 comprises a block 500 and first and second axle pins 501, 502 sized and shaped to mount in rotative bearing engagement in pin-receiving apertures 123 formed in base mount 12. Smaller block orientation pins 503, 504 are coupled to opposite ends of block 500 so that side-by-side pins 501, 503 lie in spaced-apart relation to one another to form a rib-receiving channel 505 therebetween and side-by-side pins 502, 504 lie in spaced-apart relation to one another to form a rib-receiving channel 506 therebetween as suggested in FIG. 5A.

Base mount 12 is shown, for example, in FIG. 5A. Base mount 12 includes a foundation plate 120 and a pair of upstanding strap-mount flanges 121, 122. Each flange 121, 122 is formed to include a pin-receiving aperture 123, as suggested in FIG. 5A. As suggested in FIG. 5A, each axle pin 501, 502 of strip support 50 of strap 20 is arranged to extend into one of the pin-receiving apertures 123 formed in base mount 12. An inwardly projecting rib 121R on flange 121 extends into the rib-receiving channel 505 defined between axle and orientation pins 501, 503 when strip support 50 is coupled to base mount 12 as suggested in FIG. 5A. An inwardly projecting rib 122R on flange 122 extends into the rib-receiving channel 506 defined between axle and orientation pins 502, 504 when strip support 50 is coupled to base mount 12 as also suggested in FIG. 5A.

Figure 10C:
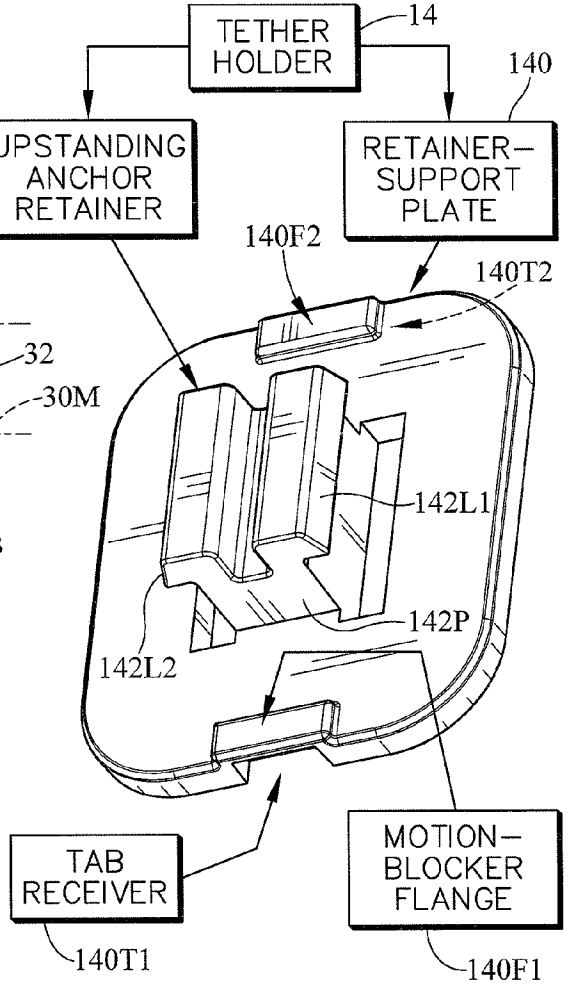
FIG. 10C is an enlarged perspective view of the tether holder of FIG. 2D.
Figure 10B:
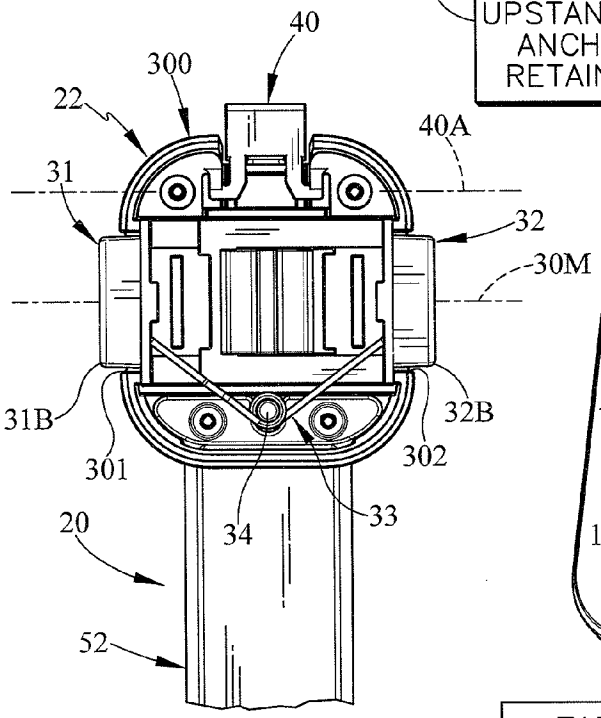
FIG. 10B is an enlarged view of the top side of the strap anchor and strap portion of FIG. 10A with a top cover of the latch housing removed to show the slidable latches, a latch-biasing spring, and the pivotable lift tab.
Figure 10A:
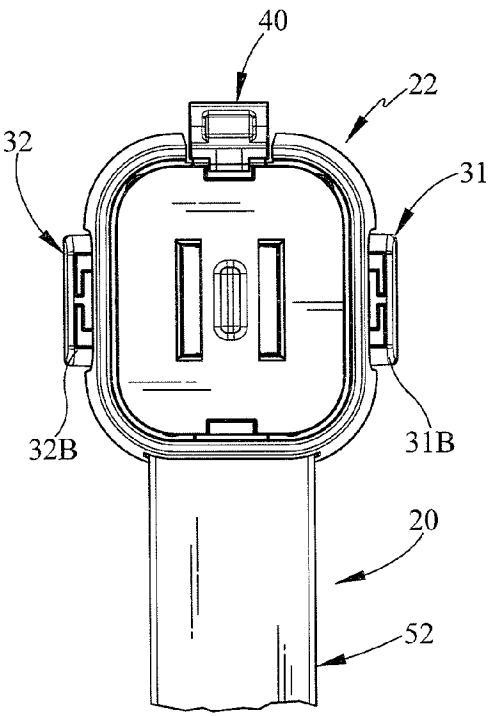
FIG. 10A is an enlarged view of a left-side portion of the panel (lid) tether showing an underside of the strap anchor.

Tether holder 14 is shown, for example, in FIGS. 5A and 10C. Tether holder 14 includes a retainer-support plate 140 adapted to be mounted on a toilet-lid panel 103 as suggested in FIG. 4 and to mate with motion-blocking tang 404 of lift tab 40 of strap anchor 22 of panel (lid) tether 16. Tether holder 14 also includes an upstanding anchor retainer 142 coupled to an upwardly facing surface of retainer-support plate 140 and arranged to mate with first and second latches 31, 32 of strap anchor 22.

Upstanding anchor retainer 142 of tether holder 14 includes a vertical post 142P, a first lip 142L1, and a second lip 142L2 as suggested in FIG. 5A. Vertical post 142P has a lower end coupled to a central portion of retainer-support plate 160. First lip 142L1 is coupled to an upper end of vertical post 142P and arranged to extend in a first direction. Second lip 142L2 is coupled to the upper end of vertical post 142P and arranged to extend in an opposite second direction.

Retainer-support plate 140 of tether holder 14 is formed to include a tab receiver 140T1 sized to receive a portion of lift tab 40 therein and a motion-blocker flange 140F1 arranged to form a ceiling above tab receiver 140T1 as suggested in FIG. 5A. Pivotable lift tab 40 includes a motion-blocking tang 404 sized to extend into a tab receiver 140T1 formed in retainer-support plate 140 and lie under a motion-blocker flange 140F1 included in retainer-support plate 140 when the pivotable lift tab 40 is arranged to lie in the normal extended position and strap anchor 22 of panel (lid) tether 16 is mated to tether holder 14 as shown in FIG. 9A. By providing an opposite side of retainer-support plate 140 of tether holder 14 with another tab receiver 140T2 and motion-blocker flange 140F2, it is easier for a caregiver to mount tether holder 14 in a proper orientation on toilet-lid panel 103 during installation of panel lock 10 on toilet 100.

A panel lock 10 is configured to be mounted on a toilet 100 by a caregiver to block a child from opening the toilet-lid panel 103 as suggested in FIGS. 2A-2D. In illustrative embodiments, panel lock 110 includes a base mount 12 adapted to be mounted on a toilet bowel 101, a tether holder 14 adapted to be mounted on a toilet-lid panel 103, and a panel (lid) tether 16 having a lower end coupled to base mount 12 and an upper end configured to mate with tether holder 14 when toilet-lid panel 103 is closed to lock toilet-lid panel 103 in a closed position above a toilet seat 102 at rest on top of toilet base 101.

In illustrative embodiments, panel (lid) tether 16 includes a strap 20 coupled to base mount 12 and a strap anchor 22 coupled to a free end of strap 20 as suggested in FIG. 5A. Strap anchor 22 is configured to be mated with the tether holder 14 that is mounted on toilet-lid panel 103 by a caregiver to lock toilet-lid panel 103 in the closed position relative to toilet bowl 101.

Tether holder 14 includes a retainer-support plate 140 mounted on an exterior surface of toilet-lid panel 103 and formed to include a tab receiver 140T1 and an upstanding anchor retainer 142 extending upwardly away from retainer-support plate 140 and toilet-lid panel 103 as suggested in FIG. 2D. One movable part of strap anchor 22 is configured to mate with upstanding anchor retainer 142 and another separate movable part of strap anchor 22 is configured to mate with retainer-support plate 140. To unlock panel lock 10, a caregiver must first unmate the first movable part from upstanding anchor retainer 142 and then unmate the second movable part from retainer-support plate 140.

In illustrative embodiments, strap anchor 22 of panel (lid) tether 16 includes (1) first and second spring-loaded latch members 31, 32 that are mounted for sliding movement in a latch housing 30 and can be mated easily with the upstanding anchor retainer 142 included in tether holder 14 and (2) a spring-loaded lift tab 40 that is mounted for pivotable movement on latch housing 30 and can be mated easily with a tab receiver 140T1 formed in the retainer-support plate 140 included in tether holder 14 to lock toilet-lid panel 103 simply by pushing strap anchor 22 downwardly onto the underlying anchor retainer 142 until the slidable spring-loaded latch members 31, 32 snap into engagement with anchor retainer 142 and pivotable lift tab 40 snaps into the tab receiver 140T1 and under a flange 140F1 formed in retainer-support plate 140. However, in accordance with the present disclosure, a caregiver must perform two separate tether-release actions A1, A2 in series to release the strap anchor 22 of panel (lid) tether 16 so that it can be separated from the tether holder 14, thereby unlocking the toilet-lid (panel) 103 so that it can be opened.

Strap anchor 22 of panel (lid) tether 16 includes first and second latches 31, 32 mounted in latch housing 30 for sliding movement toward and away from one another along a latch-movement line 30M between latched positions engaging the upstanding anchor retainer 142 to retain the strap anchor 22 of panel (lid) tether 16 in mating engagement with the upstanding anchor retainer 142 of tether holder 140 and unlatched positions disengaging the anchor retainer 142 as suggested in FIG. 5B. The outer end of each latch 31, 32 is formed to provide a squeeze button 31B or 32B that is arranged to extend outwardly through an aperture 301 or 302 formed in a side wall of latch housing 30 where it can be seen and touched by a caregiver. The first squeeze button 30B of the first latch 31 extends outwardly in one direction and the second squeeze button 31B of the second latch 32 extends outwardly and away from the first squeeze button 31B in an opposite second direction as suggested in FIGS. 5A-5C.

Strap anchor 22 of panel (lid) tether 16 also includes a lift tab 40 mounted on latch housing 30 for pivotable movement about a tab-pivot axis 40A that is arranged to lie in space-apart parallel relation to the latch-movement line 30M associated with the moving first and second latches 31, 32 as suggested in FIG. 5B. The lift tab 40 is pivotable between an extended position (see FIG. 9A) extending into the tab receiver 140T1 formed in retainer-support plate 142 of tether holder 14 to lie in confronting relation to the underside of a flange 140F1 included in retainer-support plate 142 so as to block separation of strap anchor 22 of panel (lid) tether 16 from anchor retainer 142 of tether holder 14 and a withdrawn position (see FIG. 9B) lying outside the tab receiver 140T1 to free panel (lid) tether 16 to be separated from tether holder 14 to unlock the panel lock 10.

Figure 8A:
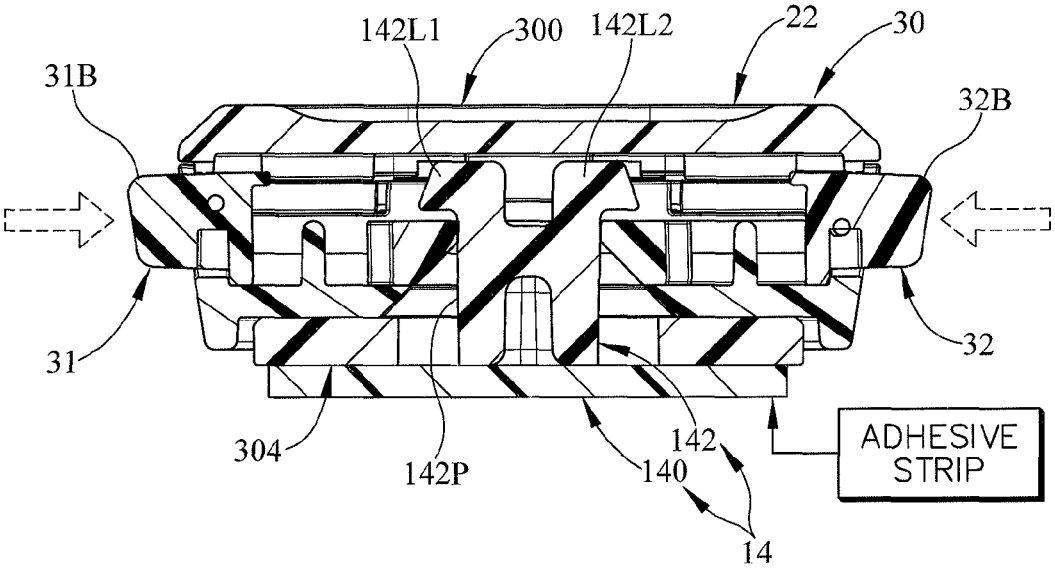
FIG. 8A is an enlarged sectional view of the strap anchor of the panel (lid) tether taken along line 8A-8A of FIG. 2A showing mating engagement of the slidable first and second latches of the strap anchor and the upstanding anchor retainer of the tether holder.
Figure 8B:
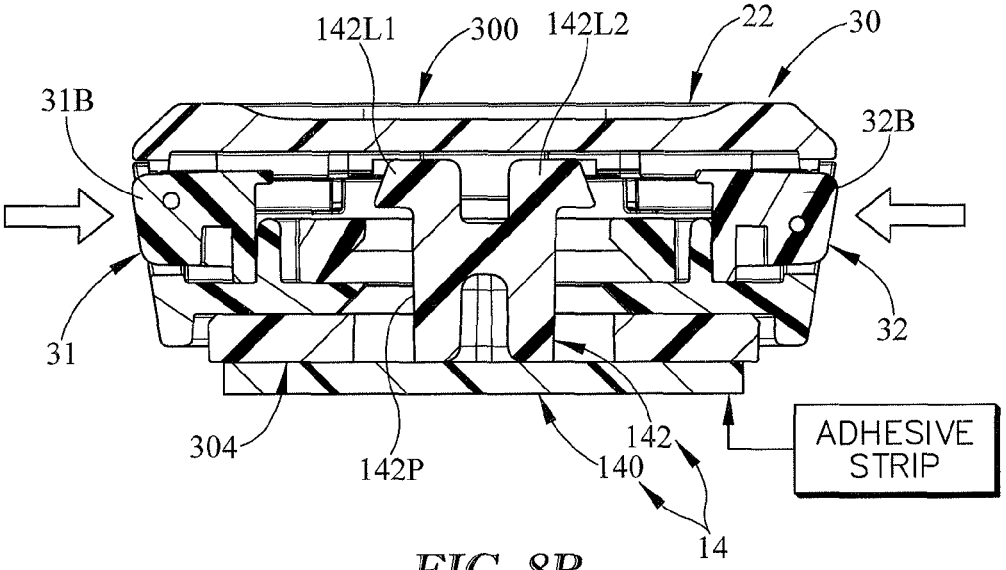
FIG. 8B is an enlarged sectional view of the strap anchor of the panel (lid) tether taken along line 8B-8B of FIG. 2A after squeezing forces have been applied by a caregiver to the first and second squeeze buttons to slide the latches in the latch housing toward one another to unmate from the upstanding anchor of the tether holder.

In illustrative embodiments, strap anchor 22 is configured to require the caregiver to carry out two separate tether-release actions A1, A2 to unlock a toilet-lid panel 103 lock in accordance with the present disclosure. First, a squeezing force is applied to both of the exposed first and second squeeze buttons 31B, 32B provided on the outer ends of the first and second latches 31, 32 to move those latches 31, 32 relative to latch housing 30 and toward one another from the latched positions shown in FIG. 8A to the unlatched positions shown in FIG. 8B to unmate from the upstanding anchor retainer 142 of tether holder 14. Second, while the caregiver continues to apply the squeezing force to the squeeze buttons 31B, 32B to cause latches 31, 32 to be held in unlatched positions shown in FIG. 8B, a lifting force is applied to lift tab 40 to cause lift tab 40 to pivot relative to latch housing 30 of strap anchor 22 about the tab-pivot axis 40A and move from the extended position shown in FIG. 9A to the withdrawn position shown in FIG. 9B to remove motion-blocking tang 404 from tab receiver 140T1 and away from motion-blocker flange 140F1 so as to unmate from retainer-support plate 142 of tether holder 14. A caregiver can apply the squeezing force and the lifting force at about the same time. Panel (lid) tether 16 cannot be separated from tether holder 14 unless both squeezing and lifting forces are applied to free strap anchor 22 to be separated from tether holder 14.

A panel lock 10 includes a base mount 12, tether holder 14, and panel tether 16 as suggested in FIG. 1B. Base mount 12 is adapted to be mounted on a relatively stationary base 1. Tether holder 14 is adapted to be mounted on a movable panel 3. Panel tether 16 includes a strap 20 and a strap anchor 22. Strap 20 is coupled to base mount 12 to move relative thereto. Strap anchor 22 is coupled to a free end of strap 20 and coupled to tether holder 14 by a caregiver to lock the movable panel 3 in a closed position relative to the relatively stationary base 1.

Tether holder 14 includes a retainer-support plate 140 and an upstanding anchor retainer 142 as suggested in FIG. 1B. Retainer-support plate 140 is adapted to be mounted on the movable panel 3 and formed to include a tab receiver 140T1. Upstanding anchor retainer 142 is coupled to the retainer-support plate 140 in spaced-apart relation to the tab receiver 140T1 and arranged to extend upwardly away from the retainer-support plate 140.

Strap anchor 22 includes a latch housing 30, a first spring-loaded latch 31, and a spring-loaded lift tab 40 as suggested in FIGS. 5A-5C. The first spring-loaded latch 31 is mounted for sliding movement in latch housing 30 normally to mate with the upstanding anchor retainer 142 included in the tether holder 14 to establish a releasable first tether lock when the latch housing 30 is positioned in a lockable position relative to the tether holder 14 to align the first spring-loaded latch 31 with the upstanding anchor retainer 140 as suggested in FIG. 1B. The spring-loaded lift tab 40 is mounted for pivotable movement on the latch housing 30 about a tab-pivot axis 40A normally to mate with the tab receiver 140T1 formed in the retainer-support plate 140 to establish a separate releasable second tether lock when the latch housing 30 is positioned in the lockable position relative to the tether holder 14 to align the spring-loaded lift tab 40 with the tab receiver 140T1 formed in the retainer-support plate 140 as suggested in FIGS. 8A and 8B.

Strap anchor further 22 includes a second spring-loaded latch 32 as suggested in FIG. 1B. The second spring-loaded latch 32 is mounted for sliding movement in latch housing 30 independent of the first spring-loaded latch 31 normally to mate with the upstanding anchor retainer 142 included in the tether holder 14 to cooperate with the first spring-loaded latch 31 to establish the releasable first tether lock when the latch housing 30 is positioned in the lockable position relative to the tether holder 14 to align the second spring-loaded latch 32 with the upstanding anchor retainer 142 as suggested in FIGS. 9A and 9B.

Upstanding anchor retainer 142 includes a post 142P, a first lip 142L1 associated with the first spring-loaded latch 31, and a second lip 142L2 associated with the second spring-loaded latch 32 as suggested in FIG. 5A. Post 142P has a lower end coupled to the retainer-support plate 140 and an opposite upper end. First lip 142L1 is coupled to the upper end of the post 142P and arranged to engage the first spring-loaded latch 31 when the latch housing 30 is positioned in the lockable position relative to the tether holder 14 as suggested in FIG. 8A. Second lip 142L2 is coupled to the upper end of the post 142P and arranged to engage the second spring-loaded latch 32 when the latch housing 30 is positioned in the lockable position relative to the tether holder 14 as suggested in FIG. 8A. First lip 142L1 is arranged to extend from the post 142P in a first direction. Second lip 142L2 is arranged to extend from the post 142 in an opposite second direction.

A process is provided in accordance with the present disclosure for unlocking a panel lock 10 including a base mount 12 adapted to be mounted on a relatively stationary base 1, a tether holder 14 adapted to be mounted on a movable panel 3, and a panel tether 16 having a first end coupled to the base mount 12 and an opposite second end adapted to be mated to the tether holder 14 to lock the panel lock 10. The process comprises the steps of applying a first tether-release action A1 to the panel tether 16 to disengage a slidable first spring-loaded latch 31 included in the panel tether 16 from the tether holder 14 and applying a second tether-release action A2 to the panel tether 16 to disengage a pivotable spring-loaded lift tab 40 included in the panel tether 16 from the tether holder 14.

The process further comprises the step of applying the first tether-release action A1 to the panel tether 16 also to disengage a slidable second spring-loaded latch 32 included in the panel tether 16 from the tether holder 14. The step of applying the first tether-release action A1 to the panel tether 16 also comprises the step of applying a squeezing force to exposed first and second squeeze buttons 31B, 32B provided on outer ends of the slidable first and second spring-loaded latches 31, 32 to move those latches 30 toward one another from latched positions to unlatched positions to unmate from the tether holder as suggested in FIG. 8B. The step of applying the second tether-release action A2 to the panel tether 16 also comprises the step of applying a lifting force to the spring-biased lift tab 40 to cause the spring-biased lift tab 40 to pivot about an axis 40A and move from an extended position to an withdrawn position so as to unmate from the tether holder 14 as suggested in FIG. 9B.

The invention claimed is:

1. A panel lock comprising a base mount adapted to be mounted on a relatively stationary base, a tether holder adapted to be mounted on a movable panel, a panel tether including a strap and a strap anchor, the strap being coupled to the base mount to move relative thereto, and the strap anchor being coupled to a free end of the strap and coupled to the tether holder, and a spring biasing a first linearly movable part for locking the movable panel in a closed position relative to the relatively stationary base, and wherein the tether holder includes a retainer-support plate adapted to be mounted on the movable panel and formed to include a tab receiver and an upstanding anchor retainer coupled to the retainer-support plate in spaced-apart relation to the tab receiver and arranged to extend upwardly away from the retainer-support plate.

2. The panel lock of claim 1, wherein the strap anchor includes the first movable part configured to move between an engaged position in which the first movable part is mated with the upstanding anchor retainer and a disengaged position in which the first movable part is spaced apart from the upstanding anchor retainer and a second movable part configured to move between a locked position in which the second movable part is mated with the retainer-support plate and an unlocked position in which the second movable part is spaced apart from the retainer-support plate, the strap anchor is coupled to the tether holder when one of the first movable part is in the engaged position and the second movable part is in the locked position and freed to move relative to the tether holder when the first movable part is in the disengaged position and the second movable part is in the unlocked position.

3. The panel lock of claim 2, wherein strap anchor further includes a latch housing and the second movable part includes a spring-loaded lift tab mounted to the latch housing for pivotable movement relative thereto and the spring-loaded lift tab extends into and is received in the tab receiver and mates with the retainer-support plate when the second movable part is in the locked position.

4. The panel lock of claim 2, wherein the strap anchor further includes a latch housing and the first movable part includes first and second spring-loaded latch members mounted for sliding movement relative to one another, the upstanding anchor retainer, and the latch housing during movement of the first movable part between the engaged position and the disengaged position.

5. The panel lock of claim 4, wherein the first and second spring-loaded latch members are mounted for linear sliding movement toward and away from one another along a latch-movement line during movement of the first movable part between the engaged position and the disengaged position.

6. The panel lock of claim 4, wherein the latch housing is formed to include a first side aperture and a second side aperture, the first spring-loaded latch member includes a first squeeze button that extends outwardly through the first side aperture in a first direction, the second spring-loaded latch member includes a second squeeze button that extends outwardly through the second side aperture in a second direction opposite the first direction, and the first and second spring-loaded latch members move relative to the latch housing and toward one another to cause the first movable part to move from the engaged position to the disengaged position in response to squeezing the first and second squeeze buttons by a caregiver.

7. The panel lock of claim 4, wherein the spring-loaded lift tab is mounted on the latch housing for pivotable movement about a tab-pivot axis that lies in spaced-apart parallel relation to the latch-movement line associated with the moving first and second spring-loaded latch members during movement of the second movable part between the locked position and the unlocked position.

8. The panel lock of claim 1, wherein the strap anchor includes a latch housing, a first spring-loaded latch, and a spring-loaded lift tab, the first spring-loaded latch is mounted for sliding movement in the latch housing normally to mate with the upstanding anchor retainer included in the tether holder to establish a releasable first tether lock when the latch housing is positioned in a lockable position relative to the tether holder to align the first spring-loaded latch with the upstanding anchor retainer, and the spring-loaded lift tab is mounted for pivotable movement on the latch housing about a tab-pivot axis normally to mate with the tab receiver formed in the retainer-support plate to establish a separate releasable second tether lock when the latch housing is positioned in the lockable position relative to the tether holder to align the spring-loaded lift tab with the tab receiver formed in the retainer-support plate.

9. The panel lock of claim 8, wherein the strap anchor further includes a second spring-loaded latch that is mounted for sliding movement in the latch housing independent of the first spring-loaded latch normally to mate with the upstanding anchor retainer included in the tether holder to cooperate with the first spring-loaded latch to establish the releasable first tether lock when the latch housing is positioned in the lockable position relative to the tether holder to align the second spring-loaded latch with the upstanding anchor retainer.

10. The panel lock of claim 9, wherein the upstanding anchor retainer includes a post, a first lip associated with the first spring-loaded latch, and a second lip associated with the second spring-loaded latch, the post has a lower end coupled to the retainer-support plate and an opposite upper end, the first lip is coupled to the upper end of the post and arranged to engage the first spring-loaded latch when the latch housing is positioned in the lockable position relative to the tether holder, and the second lip is coupled to the upper end of the post and arranged to engage the second spring-loaded latch when the latch housing is positioned in the lockable position relative to the tether holder.

11. The panel lock of claim 10, wherein the first lip is arranged to extend from the post in a first direction and the second lip is arranged to extend from the post in an opposite second direction.

12. The panel lock of claim 8, wherein the upstanding anchor retainer includes a post coupled to the retainer-support plate and a first lip coupled to the post and arranged to engage the first spring-loaded latch when the latch housing is positioned in the lockable position relative to the tether holder.

13. The panel lock of claim 8, wherein the retainer-support plate includes a motion-blocker flange arranged to form a ceiling above the tab receiver formed in the retainer-support plate, the spring-loaded lift tab includes a motion-blocking tang sized to fit into the tab receiver and lie under the motion-blocker flange when the latch housing is positioned in the lockable position relative to the tether holder.

14. The panel lock of claim 13, wherein the strap anchor further includes a second spring-loaded latch that is mounted for sliding movement in the latch housing independent of the first spring-loaded latch normally to mate with the upstanding anchor retainer included in the tether holder to cooperate with the first spring-loaded latch to establish the releasable first tether lock when the latch housing is positioned in the lockable position relative to the tether holder to align the second spring-loaded latch with the upstanding anchor retainer, the upstanding anchor retainer includes a post, a first lip associated with the first spring-loaded latch, and a second lip associated with the second spring-loaded latch, the post has a lower end coupled to the retainer-support plate and an opposite upper end, the first lip is coupled to the upper end of the post and arranged to engage the first spring-loaded latch when the latch housing is positioned in the lockable position relative to the tether holder, and the second lip is coupled to the upper end of the post and arranged to engage the second spring-loaded latch when the latch housing is positioned in the lockable position relative to the tether holder.

15. A process for unlocking a panel lock including a base mount adapted to be mounted on a relatively stationary base, a tether holder adapted to be mounted on a movable panel, and a panel tether having a first end coupled to the base mount and an opposite second end adapted to be mated to the tether holder to lock the panel lock, the process comprising the steps of applying a first tether-release action to the panel tether to linearly slide and disengage a slidable first spring-loaded latch included in the panel tether from the tether holder, and applying a pivotal force to the panel tether to disengage a pivotable spring-loaded lift tab included in the panel tether from the tether holder, and wherein the slidable first spring-loaded latch slides along a first axis and the pivotable spring-loaded lift tab pivots about a second axis spaced from and parallel to the first axis.

16. The process of claim 15, further comprising the step of applying the first tether-release action to the panel tether also to disengage a slidable second spring-loaded latch included in the panel tether from the tether holder.

17. The process of claim 16, wherein the step of applying the first tether-release action to the panel tether comprises the step of applying a squeezing force to exposed first and second squeeze buttons provided on outer ends of the slidable first and second spring-loaded latches to move those latches toward one another from latched positions to unlatched positions to unmate from the tether holder.

18. The process of claim 17, wherein the step of applying the second tether-release action to the panel tether comprises the step of applying a lifting force to the spring-biased lift tab to cause the spring-biased lift tab to pivot about an axis and move from an extended position to an withdrawn position so as to unmate from the tether holder.

19. The process of claim 16, wherein the step of applying the second tether-release action to the panel tether comprises the step of applying a lifting force to the spring-biased lift tab to cause the spring-biased lift tab to pivot about an axis and move from an extended position to an withdrawn position so as to unmate from the tether holder.

20. A panel lock comprising a movable panel moveable relative to a relatively stationary base between a closed position and an open position, a base mount adapted to be mounted on the relatively stationary base, a tether holder adapted to be mounted on the movable panel, means for yieldably moving at least one linearly slidable latch for locking the movable panel in the closed position relative to the relatively stationary base, and unlocking means for sliding the slidable latch along a first axis and for pivoting a lift tab about a second axis spaced from the first axis for unlocking the movable panel from the relatively stationary base.

21. The panel lock of claim 20, further comprising a tether including a strap and a strap anchor, the strap being coupled to the base mount to move relative thereto, and the strap anchor being coupled to a free end of the strap.

* * * * *